US006598537B2

(12) United States Patent
DeLucia et al.

(10) Patent No.: US 6,598,537 B2
(45) Date of Patent: Jul. 29, 2003

(54) TIE PLUGGER RIDING STATION AND ASSOCIATED METHOD

(75) Inventors: Anthony DeLucia, Gaston, SC (US); John Sanders, Lexington, SC (US)

(73) Assignee: Harsco Technologies Corporation, Fairmont, MN (US)

( * ) Notice: Subject to any disclaimer, the term of this patent is extended or adjusted under 35 U.S.C. 154(b) by 0 days.

(21) Appl. No.: 09/989,839

(22) Filed: Nov. 20, 2001

(65) Prior Publication Data

US 2003/0094114 A1 May 22, 2003

(51) Int. Cl.[7] ..... E01B 29/00
(52) U.S. Cl. ..... 104/2; 104/17.1
(58) Field of Search ..... 104/2, 17.1, 17.2, 104/16; 105/86

(56) References Cited

U.S. PATENT DOCUMENTS 2,051,864 A 8/1936 Knox et al.
3,144,835 A 8/1964 Pehoski et al.
3,563,319 A * 2/1971 Nixon ..... 104/17.1
3,810,516 A 5/1974 Reimer
3,943,858 A * 3/1976 Dieringer et al. ..... 104/16
5,636,574 A * 6/1997 Pierrot ..... 104/17.1
5,671,679 A * 9/1997 Straub et al. ..... 104/17.1

FOREIGN PATENT DOCUMENTS

DE 1952821 A1 12/1970
FR 794572 A 2/1936

* cited by examiner

*Primary Examiner*—Mark T. Le
(74) *Attorney, Agent, or Firm*—David C. Jenkins; Eckert Seamans Cherin & Mellott, LLC

(57) ABSTRACT

A tie plugger riding station which includes a main frame assembly, a seat assembly coupled to the frame assembly, at least one rail wheel coupled to the frame assembly, an articulated wheel assembly, and a coupling device structured to couple the frame assembly to a plugging machine. The articulated wheel assembly includes a truss frame assembly having a main pivot coupling and at least two wheel member pivot couplings. The truss frame assembly is pivotally coupled to the frame assembly at the main pivot coupling. The two wheel members are each pivotally coupled to the truss frame assembly at a wheel member pivot coupling.

25 Claims, 3 Drawing Sheets

TIE PLUGGER RIDING STATION AND ASSOCIATED METHOD

BACKGROUND OF THE INVENTION

1. Field of the Invention

This invention relates to devices for plugging spike holes in railroad ties and, more specifically, for a riding station upon which an operator may sit while plugging spike holes and which is towed by a conventional plugging machine. This invention further provides for a method of using a tie plugger riding station.

2. Background Information

Railroad repair and maintenance includes the removal and re-laying of track on a railroad bed. Typically, only one rail at a time is removed for the repair/maintenance operation. To remove the rail, the railroad spikes, and/or the spikes securing the tie plates, must be removed. After the rail is removed, a tie with empty spike holes remains. To ensure that the rail is properly secured when re-laid, the spike holes must be plugged so that the new spike can find purchase when installed.

The plugging of spike holes once was accomplished using wood plugs which were inserted into the holes. Modern tie plugging, however, is mostly performed using chemicals, e.g., urethane or epoxy-based compounds. The chemical plug material is typically separated into two components, e.g., a resin and a curing agent. An operator uses an injection gun, which combines the two components, to fill a spike hole with the chemical plug. To perform this operation, or to drive wooden plugs into spike holes, an operator must walk behind a plugging as machine described below.

A plugging machine is, typically, a self-propelled vehicle having at least one rail wheel and a non-rail wheel. The plugging machine carries tanks filled with the chemical components used to make the plug and a pump. The plugging machine also carries heaters, proportioners, storage drums and other equipment. The chemical components are pumped through hoses to an injection gun which, as described above, is used to insert the combined compound in the spike hole. The vehicle does not, however, carry the injection gun operators.

The non-rail wheel of the plugging machine travels over the railroad bed adjacent to, or over top of, the location where the rail was removed. The railroad bed includes the exposed tie tops, various debris, and ballast cribs, that is, the interstice between ties, which may be filled with ballast or empty. Thus, the railroad bed is a very rough surface to travel over. A surface so rough, in fact, that the plugging machine shakes too much for an injection gun operator to ride thereon and perform the injection procedure. That is, the plugging machine shakes so much that the injection gun operator is not able to effectively line up or insert the injection gun in most spike holes. Thus, the injection gun operator is forced to walk behind the plugging machine, carrying the injection gun.

Plugging operations could be achieved faster and with less strain on the injection gun operators if the injection gun operator did not have to walk. There is, therefore, a need for a riding station upon which injection gun operators could ride.

There is a further need for a riding station that provides a ride sufficiently smooth enough for the injection gun operator to align the injection gun with the empty spike holes.

There is a further need for a riding station that is compatible with existing equipment.

SUMMARY OF THE INVENTION

These needs, and others, are satisfied by the present invention which provides a riding station having an articulated wheel assembly. As on the plugging machine, the riding station has at least one rail wheel structured to ride on the rail that remains in place. The other side of the riding station, however, is supported by an articulated multi-wheeled truss frame having a plurality of pivot points. Because the truss frame has more than a single pivot point between the wheels and the frame assembly of the riding station, the truss frame wheel assembly provides a ride that is sufficiently smooth for an injection gun operator to sit on the riding station and plug spike holes.

The truss frame has a main pivot coupling and two-wheel member pivot couplings. The truss frame is rotatably coupled to the main frame assembly by the main pivot coupling. Two wheel members, which are typically rigid bars, are rotatably coupled to the truss frame at the wheel member pivot couplings. Two wheels are rotatably attached at either end of each wheel member. That, the wheels are disposed on either side of the wheel member pivot couplings. This configuration provides multiple pivot points between the wheels and the main frame assembly.

At least one seat assembly is disposed on the main frame assembly. The seat assembly includes an injection gun support assembly that allows the injection gun to be moved vertically and horizontally. The injection gun is coupled to the gun support assembly so that the nozzle of the injection gun is located proximal to the spike holes in the ties.

The main frame assembly further includes two steering bars that are structured to be attached to a plugging machine. The steering bars extend from the main frame assembly and cross before the plugging machine coupling ends. The steering bars, and the seat assembly, may be oriented towards the front side or the back side of the main frame assembly. That is the seat assembly and the steering bars may be used regardless of whether the rail-wheel is located on the right side of the main frame assembly or the left side. Thus, the riding station may be used regardless of which rail, left or right, has been removed.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
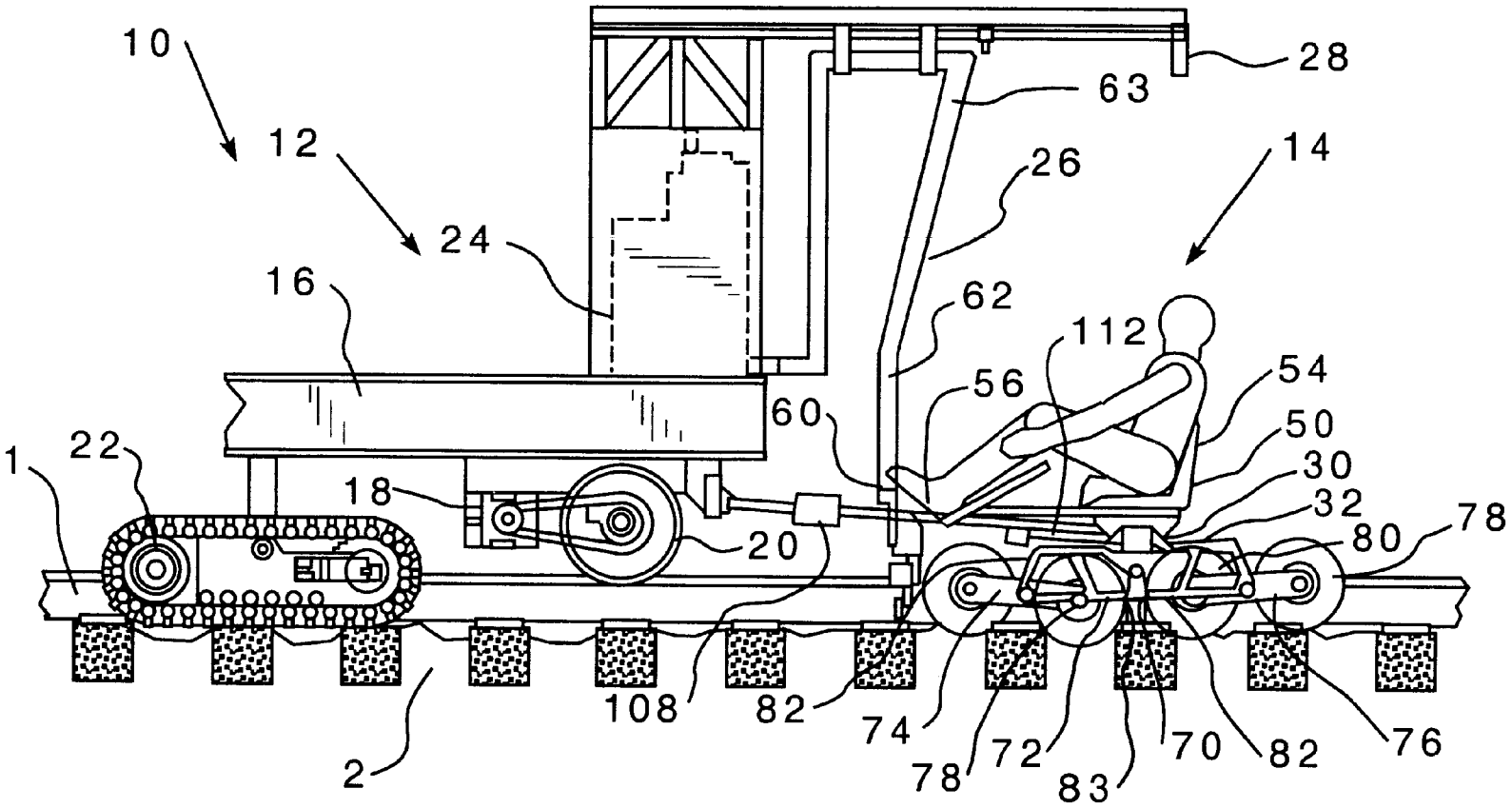
FIG. 1 is a side view of the riding station being towed by a plugging machine.
Figure 2:
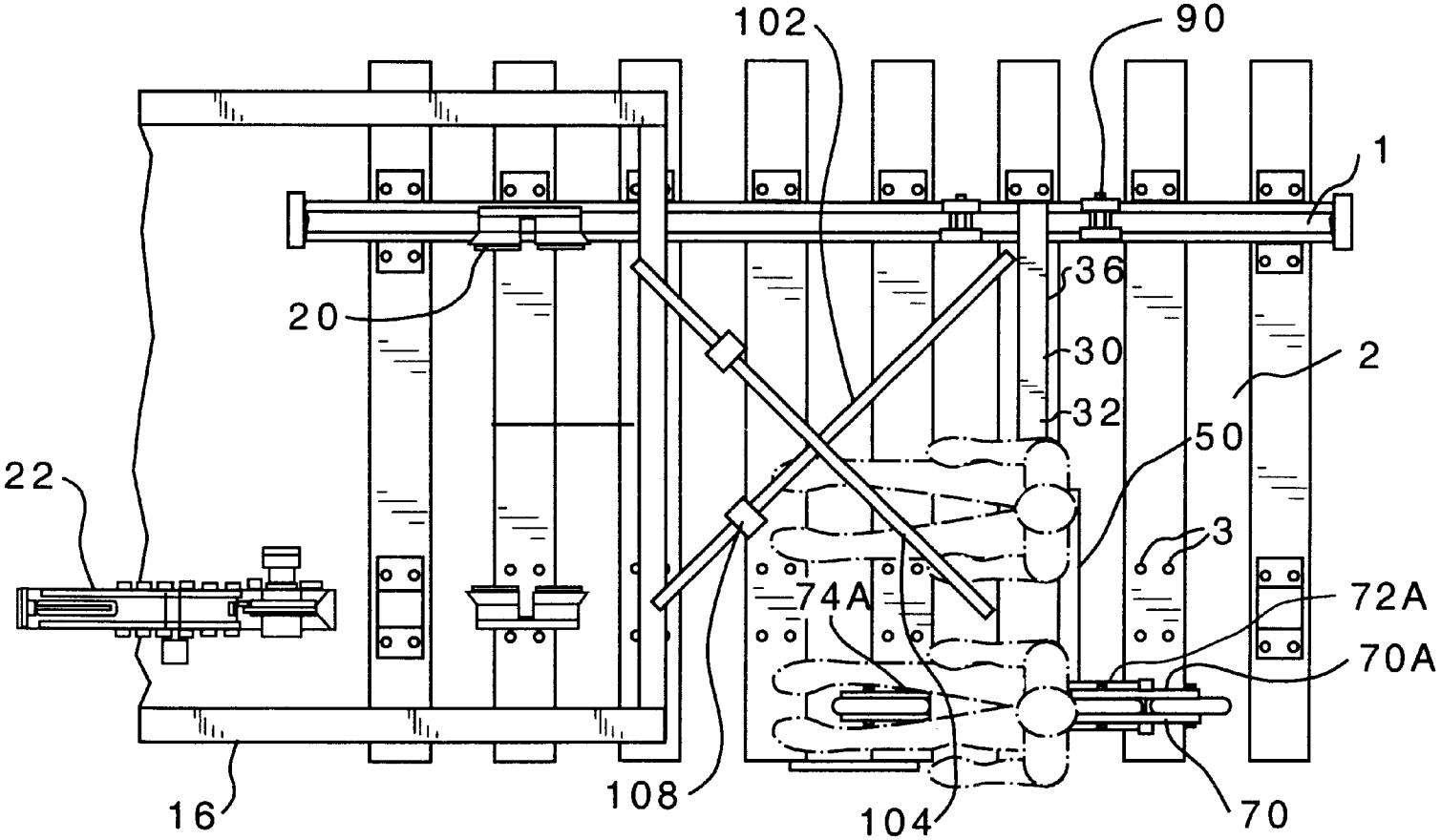
FIG. 2 is a top view of the riding station being towed by a plugging machine.
Figure 3:
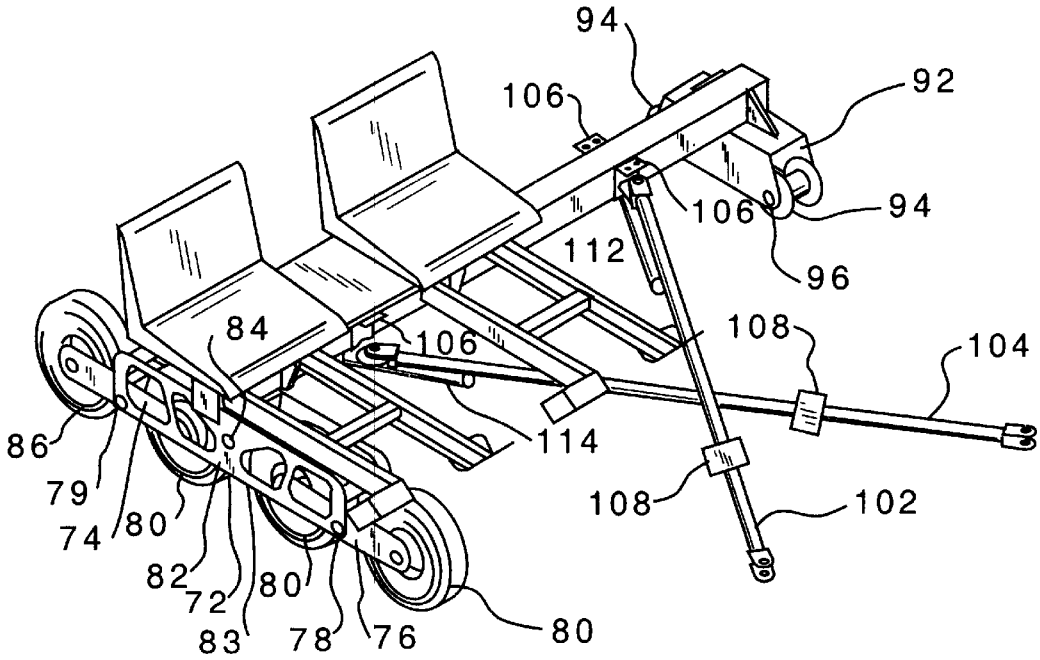
FIG. 3 is an isometric view of the riding station.

As shown in FIGS. 1 and 2, a plugging system 10 includes a plugging machine 12 and a riding station 14. The plugging system 10 is structured to travel on one railroad rail 1 and a railroad bed 2. Typically, a railroad would have two tails, however, during maintenance and repair, one rail is removed leaving exposed spike holes 3 (FIG. 2). The plugging machine 12 includes a body frame 16, a motor 18, at least one rail wheel 20, a crawler 22, at least one storage unit 24, a plurality of hoses 26, and a tool balancer 28. The rail wheel 20 is adapted to travel on the rail 1. The rail wheel 20 is coupled to the motor 18. The motor 18, rail wheel 20, and crawler 22 are coupled to the lower side of the body frame 16. The crawler 22 is adapted to travel on the railroad bed 2. The storage unit 24 is disposed on top of the body frame 16. The storage unit 24 holds the chemical components used to plug the spike holes 3. The storage unit 24 also includes a pump (not shown). The hose 26 is in fluid communication with the storage unit 24. The tool balancer 28 is disposed above the storage unit 24 and extends over the back edge of the body frame 16. The tool balancer 28 supports the hoses 26 so that the distal end of the hoses 27 hangs vertically and opens downwardly.

The riding station 14 includes a main frame assembly 30, a seat assembly 50, an articulated wheel assembly 70, a rail wheel assembly 90, and a coupling device 100. The main frame assembly 30 includes a main beam 32 which extends for a length about twenty-three inches longer than the spacing of standard railroad tracks, from about one meter to sixty-six inch gage. The main frame assembly 30 is disposed generally laterally across the railroad bed 2. The main frame assembly 30 has a front side 34 and a back side 36. The front side 34 is located adjacent to plugging machine 12. The back side 36 is located away from plugging machine 12. A coupling plate 38 extends below the one end of the main beam 32. The coupling plate 38 includes a pivot pin 39 extending in a generally horizontal direction.

Figure 4:
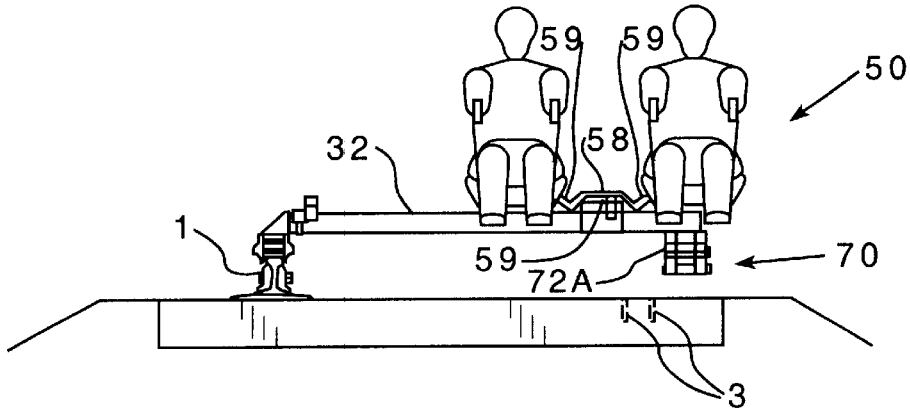
FIG. 4 is a cross-sectional front view of the riding station.

The seat assembly 50 includes a seat coupling 52, a seat 54 structured to support a human, a foot rest 56 disposed in front of the seat 54, and an injection gun support 58. The seat coupling 52, as best shown on FIG. 4, attaches the seat assembly 50 to the main beam 32. The seat coupling 52 includes a means for reversing the direction of the seat assembly 50. That is, the coupling means 52 allows the seat assembly to face either the front side 34 or the back side 36 of the frame assembly 30. The means for reversing the direction of the seat may be a pivot 59 or may be a disengagable means for securing the seat assembly 50 to the main beam 32. The gun support 58 is disposed adjacent to the seat 54. The gun support 58 is a bar extending generally horizontally adjacent to the base of the seat 54. The gun support 58 may have a U-shaped portion 59 that is engaged by the injection gun hook 67 (described below) and aids in positioning the injection gun assembly. The gun support maintains the injection gun nozzle 68 (described below) at a generally fixed height above the top of the railroad tie spike holes 3.

The gun support 58 supports an injection gun assembly 60. The injection gun assembly 60 includes a hose coupling 62, a frame 64, a trigger assembly 65, an arm cuff 66, a support hook 67 and a nozzle 68. The hose coupling 62 is coupled to, and in fluid communication with, the plurality of hoses 26. The hose coupling 62 is further coupled, and in fluid communication with, to the frame 64. The frame 64 includes internal channels (not shown) through which the chemical components may travel. The nozzle 68 is located at the lower distal end of the frame 64 and is in fluid communication with the frame 64 channels. The nozzle 68 is structured to align with the spike holes 3. The upper end of the frame 64 includes the arm cuff 66 and the support hook 67. The support hook 67 is structured to engage the gun support 58. The arm cuff 66 is positioned to be adjacent to a user sitting in the seat assembly 50. The trigger assembly 65 is attached to the frame 64 just below the arm cuff 66. Thus, a user may place his or her arm through the arm cuff 66 and grasp the trigger assembly 65. The user may further manipulate the position of the nozzle 68 by pivoting the injection gun assembly 60 about the interface between the gun support 58 and the support hook 67. The injection gun assembly 60 is structured to combine the chemical components from the storage unit 24 to form the plugging compound.

The articulated wheel assembly 70 is disposed at the end of the main beam 32 with the coupling plate 38. The articulated wheel assembly includes a truss frame assembly 72, at least two wheel members, 74, 76, a plurality of pivot pins 78, and a plurality of wheels 80. The truss frame assembly 72 includes a plurality of rigid members 82 forming an elongated frame 83. A main pivot coupling 84 is disposed on the rigid members 82. Where, as described above, the coupling plate 38 on the main bar 32 includes a pivot pin 34, the pivot coupling 84 is an opening corresponding to the size of the pivot pin 39. The locations of the pivot pin 39 and the opening could, however, be reversed. That is, the pivot pin 39 could be on a rigid frame member 82 and the opening could be on the coupling plate 38. Two wheel member pivot couplings 86 are disposed on the rigid members 82, one wheel member pivot coupling 86 at each end of the elongated frame 83. The wheel member pivot couplings 86 are openings through which a pivot pin 78 passes. The wheel members 74, 76 are elongated rigid members having a central pivot opening (not shown) and an axle 88 at each end. A pivot pin 78 passes through the wheel member 74, 76 central opening thereby forming the wheel member pivot coupling 86. A wheel 80 is disposed on each axle 88. The wheels 80 are inflatable and may be under inflated. As best seen on FIG. 2, additional support may be provided by a second truss frame assembly 72A and a second set of wheel members 74A, 76A disposed on the other side of the wheels 80.

This configuration allows the main beam 32 to remain generally stable as the articulated wheel assembly 70 travels over the railroad bed. The changes in the uneven railroad bed 2 are absorbed by the under inflated wheels 80, by the wheel members 74, 76 pivoting on the wheel member pivot coupling 86 and by the truss frame assembly 72 pivoting on the main pivot coupling 84.

The rail wheel assembly 90 is disposed on the side of the main beam 32 opposite the articulated wheel assembly 70. The rail wheel assembly 90 includes a bracket 92, and at least one rail wheel 94. The rail wheel 94 is adapted to travel on a railroad rail 1. The bracket 92 is coupled to the main beam 32. The bracket has at least one axle 96 attached thereto. The rail wheel 94 is disposed on the rail wheel bracket axle 96.

The coupling device 100 includes two steering bars 102, 104 and four steering bar brackets 106. Two brackets 106 are disposed on the front side 34 of the main beam 32, and two brackets 106 are disposed on the back side 36 of the main beam 32. The steering bars 102, 104 are pivotally coupled to two of the steering bar brackets 106 on one side of the main beam and extend toward the plugging machine 12. The steering bars 102, 104 are disposed at an acute angle relative to the main beam 32 and each other so that said steering bars 102, 104 cross each other prior to contacting the plugging machine 12. The steering bars 102, 104 each include an adjustable damper 108. When the seat assembly 50 is reversed, the steering bars 102, 104 are coupled to the steering bar brackets 106 on the other side of the main beam 32. The steering bars 102, 104 are also pivotally coupled to the plugging machine 12.

For added stability during operation, each steering bar 102, 104 may also include a stabilizing bar 112, 114. The stabilizing bars 112, 114 extend between a steering bar 102, 104 and the main beam 32. The stabilizing bars 112, 114 are pivotally attached to the main beam 32. Each stabilizing bars 112, 114 is pivotally couple to a steering bar 102, 104 at a location about thirty inches from the main beam 32. Each end of each stabilizing bar 112, 114 may be threaded and coupled to a cuff 116 that is pivotally attached to the stabilizing bar 112, 114. As such, the stabilizing bars 112, 114 may be used to level the main beam 32 and to resist a rocking motion caused by an operator shifting his or her weight.

In operation, the plugging system 10 is disposed on a railroad track 1 and railroad bed 2 which is being repaired. That is, there is only one railroad track 1 in place and the other railroad track has been removed leaving exposed spike holes 3. The plugging machine rail wheel 20 is disposed on the rail 1. The riding station rail wheel 94 is also disposed on the rail 1. Both the plugging machine crawler 22 and the riding station articulated wheel assembly 70 are disposed on the railroad bed 2. The injection gun assembly 60 is coupled to the hose 26. The riding station 14 is coupled to the plugging machine 12 by the coupling device 100.

The plugging machine motor 18 provides the power to move the plugging system 10 along the railroad rail 1 and railroad bed 2. An operator sits in seat assembly 50 with the injection gun assembly 60 in hand. The gun support 58 supports the injection gun assembly 60 adjacent to the seat 54. The seat 54 is disposed, generally, above the spike holes 3. As the plugging system 10 advances along the rail 1 and over railroad bed 2 under the power of the plugging machine motor 18, the operator inserts the injection gun nozzle 68 into each exposed spike hole 3 and fills each spike hole 3 with the plugging compound. The seat 54 is held relatively steady as the articulated wheel assembly 70 adapts to the changing railroad bed 2. Thus, the operator is carried by the riding station 14 during the repair procedure.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A tie plugger riding station comprising:

a main frame assembly;

a seat assembly coupled to said frame assembly;

at least one rail wheel coupled to said frame assembly;

a wheel assembly coupled to said frame assembly; and a coupling device structured to couple said frame assembly to a separate vehicle supporting a plugging machine.

2. The tie plugger riding station of claim 1, wherein said wheel assembly is an articulated wheel assembly which includes:

a truss frame assembly having a main pivot coupling and at least two wheel member pivot couplings;

said truss frame assembly pivotally coupled to said frame assembly at said main pivot coupling;

two wheel members, each pivotally coupled to said truss frame assembly at a wheel member pivot coupling; and a plurality of wheels rotatably coupled to each said wheel member.

3. The tie plugger riding station of claim 2, wherein:

said wheel members are elongated, rigid members having a central pivot opening;

said plurality of wheels coupled to each wheel member includes two wheels coupled to said wheel member; and said wheels coupled to said wheel member on opposite sides of said central pivot opening.

4. The tie plugger riding station of claim 3, wherein each said tire is an inflatable tire.

5. The tie plugger riding station of claim 1, wherein said coupling device includes:

two steering bars extending from said frame assembly; and said steering bars disposed at an angle relative to said frame assembly so that said steering bars cross each other.

6. The tie plugger riding station of claim 5, wherein each steering bar includes an adjustable damper.

7. The tie plugger riding station of claim 6, wherein:

each said steering bar is removably coupled to said frame assembly;

said frame assembly has a front side and a back side; and said frame assembly includes coupling brackets for said steering bars on both said front side and said back side.

8. The tie plugger riding station of claim 1, wherein said seat assembly includes:

an injection gun support; and a seat structured to support a human.

9. The tie plugger riding station of claim 8, wherein:

said frame assembly has a front side and a back side; and said seat assembly is structured to attach to said frame assembly facing either said front side or said back side.

10. The tie plugger riding station of claim 8, wherein:

said frame assembly has a front side and a back side; and said seat assembly is structured to pivotally attach to said frame assembly so that said seat may facing either said front side or said back side.

11. A plugging system for repairing damaged railroad ties with chemical components, said plugging system comprising:

a plugging machine having a body frame, a motor, at least one rail wheel, a crawler, at least one storage unit, a hose, and a hose support;

said storage unit structured to hold the chemical components of a railroad tie plug;

said hose in fluid communication with said storage unit;

an injection gun assembly coupled to, and in fluid communication with, said hose;

said injection gun assembly structured to combine the chemical components of railroad tie plug and having a nozzle structured to fit within a spike hole; and a riding station structured to support an injection gun assembly operator.

12. The plugging system of claim 11 wherein said riding station comprises:

a main frame assembly;

a seat assembly coupled to said frame assembly;

at least one rail wheel coupled to said frame assembly;

an articulated wheel assembly coupled to said frame assembly; and a coupling device structured to couple said frame assembly to a plugging machine.

13. The plugging system of claim 12, wherein said articulated wheel assembly includes:

a truss frame assembly having a main pivot coupling and at least two wheel member pivot couplings;

said truss frame assembly pivotally coupled to said frame assembly at said main pivot coupling;

two wheel members, each pivotally coupled to said truss frame assembly at a wheel member pivot coupling; and a plurality of wheels rotatably coupled to each said wheel member.

14. The plugging system of claim 13, wherein:

said wheel members are elongated, rigid members having a central pivot opening;

said plurality of wheels coupled to each wheel member includes two wheels coupled to said wheel member; and said wheels coupled to said wheel member on opposite sides of said central pivot opening.

15. The plugging system of claim 14, wherein each said tire is an inflatable tire.

16. The plugging system of claim 12, wherein said coupling device includes:

two steering bars extending from said frame assembly; and said steering bars disposed at an angle relative to said frame assembly so that said steering bars cross each other.

17. The plugging system of claim 16, wherein each steering bar includes an adjustable damper.

18. The plugging system of claim 17, wherein:

each said steering bar is removably coupled to said frame assembly;

said frame assembly has a front side and a back side; and said frame assembly includes coupling brackets for said steering bars on both said front side and said back side.

19. The plugging system of claim 12, wherein said seat assembly includes:

an injection gun support structured to support said injection gun assembly; and a seat structured to support a human.

20. The plugging system of claim 19, wherein:

said frame assembly has a front side and a back side; and said seat assembly is structured to attach to said frame assembly facing either said front side or said back side.

21. The plugging system of claim 19, wherein:

said frame assembly has a front side and a back side; and said seat assembly is structured to pivotally attach to said frame assembly so that said seat may facing either said front side or said back side.

22. The plugging system of claim 19, wherein said storage unit includes a tool balancer structured to support said hose above said seat assembly.

23. A method of plugging spike holes in a tie on a railroad using a plugging system wherein said plugging system includes a self propelled plugging machine having a storage unit containing the chemical components of a railroad tie plug, said storage unit coupled to, and in fluid communication with, an injection gun assembly, and a riding station, said riding station having a main frame assembly, a seat assembly coupled to said frame assembly, at least one rail wheel coupled to said frame assembly, a non-rail wheel assembly, and a coupling device structured to couple said frame assembly to said plugging machine, said method comprising the steps of:

a) an operator sitting in said seat assembly;

b) said operator using said in injection gun assembly to insert the chemical components of a railroad tie plug into said spike hole; and c) advancing said plugging machine along said railroad.

24. The method of claim 23 having the step of:

a) employing an articulate wheel assembly as the non-rail wheel assembly.

25. The method of claim 24 having the step of:

a) employing an articulate wheel assembly that includes:

a truss frame assembly having a main pivot coupling and at least two wheel member pivot couplings;

said truss assembly pivotally coupled to said frame assembly at said main pivot coupling;

two wheel members, each pivotally coupled to said truss frame assembly at a wheel member pivot coupling; and a plurality of wheels rotatably coupled to each said wheel member.

* * * * *

UNITED STATES PATENT AND TRADEMARK OFFICE

CERTIFICATE OF CORRECTION

PATENT NO. : 6,598,537 B2 
DATED : July 29, 2003
INVENTOR(S) : Anthony DeLucia et al.

It is certified that error appears in the above-identified patent and that said Letters Patent is hereby corrected as shown below:

Column 6,
Line 54, after "components of", insert -- a --.

Column 8,
Lines 31 & 34, "articulate" should read -- articulated --.
Line 37, after "truss" insert -- frame --.

Signed and Sealed this

Eighteenth Day of November, 2003

JAMES E. ROGAN
*Director of the United States Patent and Trademark Office*